United States Patent [19]

Schubert et al.

[11] 3,935,962

[45] Feb. 3, 1976

[54] CONTAINER

[75] Inventors: John C. Schubert; Steven Cyr, both of Chippewa Falls; Charles B. Case, Eau Claire, all of Wis.

[73] Assignee: Standard Oil Company, Chicago, Ill.

[22] Filed: Nov. 20, 1974

[21] Appl. No.: 525,390

[52] U.S. Cl. ..... 220/306; 220/3.1

[51] Int. Cl. ..... B65d 43/02

[58] Field of Search ..... 220/306, 307, 4 R, 4 B, 220/3.1; 229/2.5, 43

[56] References Cited

UNITED STATES PATENTS

| | | | |
|---|---|---|---|
| 2,884,155 | 4/1959 | Hanson | 229/2.5 X |
| 3,620,403 | 11/1971 | Rump | 229/2.5 X |
| 3,633,785 | 1/1972 | Cyr et al. | 229/2.5 X |
| 3,851,789 | 12/1974 | Case et al. | 220/307 |

*Primary Examiner*—William Price
*Assistant Examiner*—Steven M. Pollard
*Attorney, Agent, or Firm*—Gregory E. Croft; Arthur G. Gilkes; William T. McClain

[57] ABSTRACT

Locking means for a deformable plastic container having a top and bottom, such as foamed plastic food containers, which provides a positive closure but which does not interfere with stacking of empty containers, said means comprising on one part (generally the top) a protruding edge or lip which can engage an opening in the second member (generally the bottom), said opening being located in an inwardly protruding surface in a sidewall.

15 Claims, 13 Drawing Figures

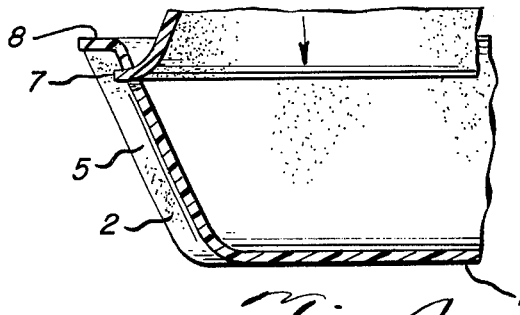
Fig. 4
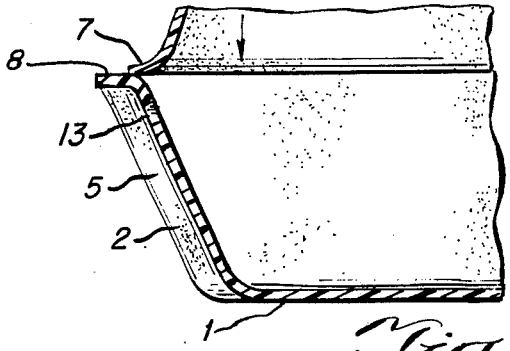
Fig. 3
Fig. 2
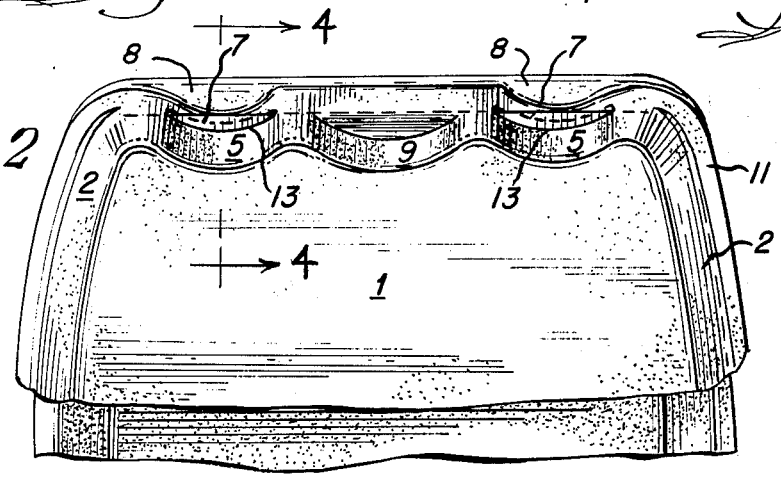
Fig. 1
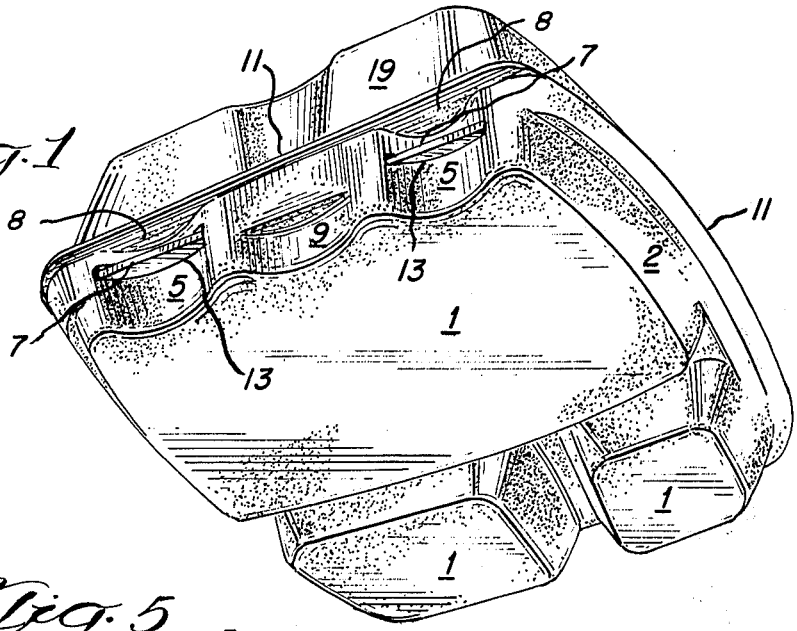
Fig. 5
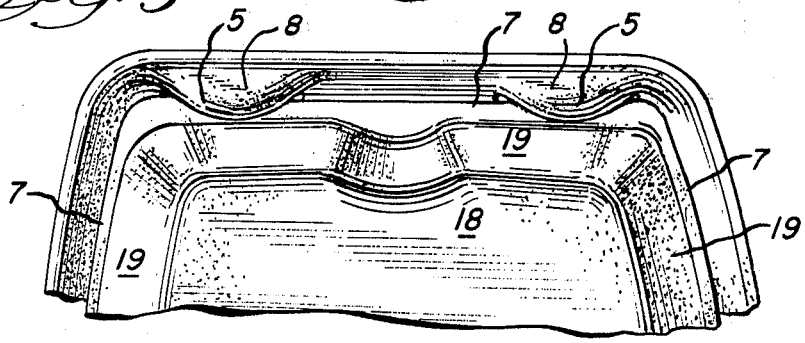

Fig. 10 PRIOR ART
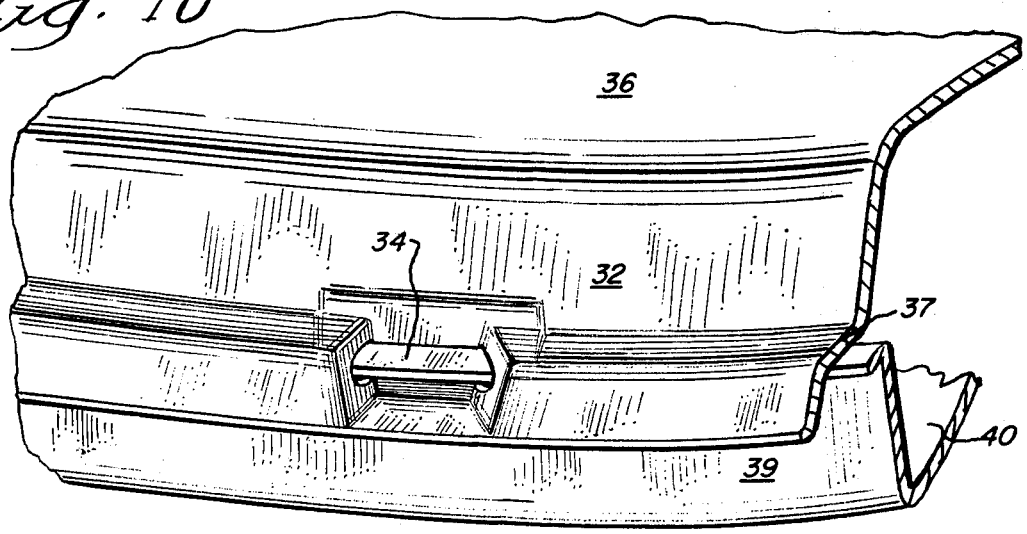
Fig. 11 PRIOR ART
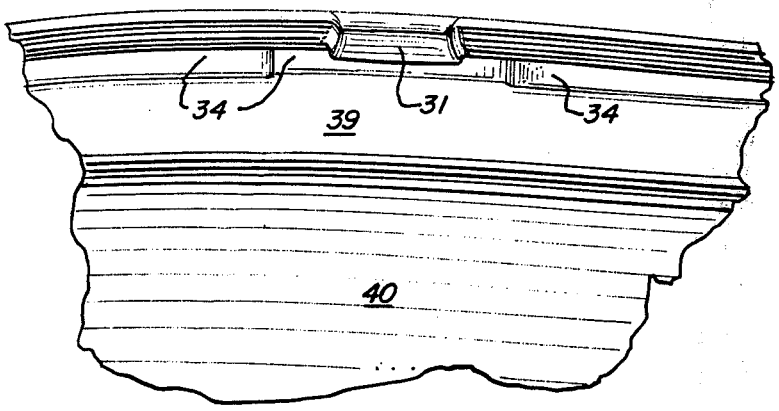
Fig. 12 PRIOR ART
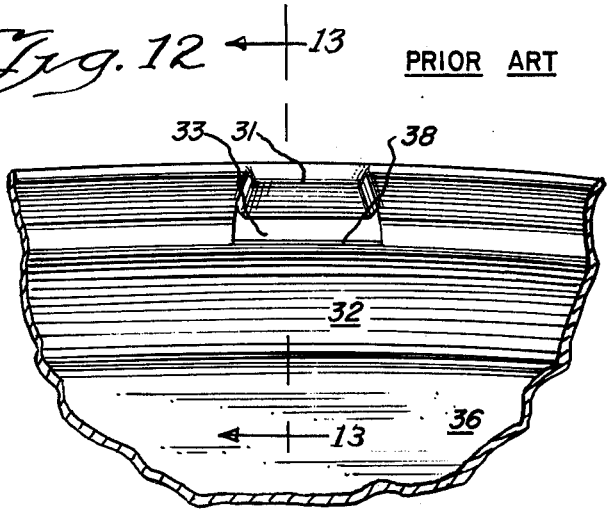
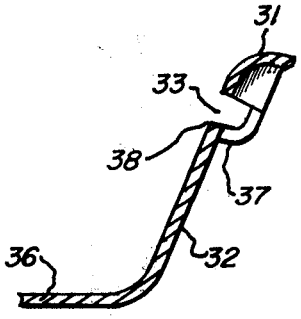
Fig. 13
PRIOR ART

CONTAINER

FIELD OF THE INVENTION

Deformable plastic containers, generally foamed, are widely used in the food service field where containers are filled at one location and transmitted to another location. These normally are either two-piece containers where a lid and base member snap together or one-piece having a hinged common border and a snap-in feature at the other end.

Disclosed is an improvement in the locking means by which the top and bottom of the container are locked together.

DESCRIPTION OF THE PRIOR ART

Cyr et al, U.S. Pat. No. 3,633,785 (1972) discloses a foamed-plastic hot food container generally similar to one of the containers disclosed herein and said patent is incorporated herein by reference. In that patent the locking portion on the bottom has a Z-cross section incorporating a reverse-tapered sidewall which engages a lip on the top. While this is an effective locking system, the reverse-tapered sidewall does not interfere with the close stacking of empty containers.

Other containers of the prior art use "tab" type latching mechanisms. Containers having a folding or formed tab type closure can be made to have good stacking features, but generally require more time to close. This is disadvantageous in most situations, particularly in carry-out fast food operations where speed and efficiency are essential. Also, the presence of tabs can add to the material required to construct the container without adding to its carrying capacity. Furthermore, these tabs are structurally weak and vulnerable to being damaged during handling or upon opening and closing the containers.

Another type of container more closely resembling the container of this invention is illustrated in FIGS. 10–13. FIG. 10 is a fragmentary perspective view of the prior art closure means, viewed from the front of the container. Shown is the base 36 of the second member, a sidewall 32, the indentation 31 with the lip 34 of the first member engaged, the step configuration in the sidewall of the second member forming a rim 37, and a sidewall 39 of the first member. It should be noted that the indentation 31 in the prior art container is located in the top member, whereas in the preferred embodiments of our invention the inwardly protruding surface is shown in the bottom member. For the sake of clarity, the member having the indentation or inwardly protruding surface will be referred to as the second member.

FIG. 11 is a fragmentary bottom view of the same container, also in a closed position, showing the base 40 of the first member, the sidewall 39 of the first member, the lip 34 of the first member, and the indentation 31 of the second member.

FIG. 12 is a sideview of the second member viewed from inside the container to illustrate the relation between the slot and the indentation. Shown is the base 36 of the second member, a sidewall 32, the straight slot 33, and the indentation 31.

FIG. 13 is a fragmentary section taken along line 13—13 in FIG. 12, further illustrating the relationship between the indentation, the slot, and the sidewall. Shown is the base 36 of the second member, the sidewall 32, the straight slot 33, the innermost edge 38 of said slot, the rim 37 formed by the step configuration in the sidewall, and the indentation 31.

The indentation 31 is generally rectangular in form, measuring approximately 0.85 inches in length (parallel to the edge of the second member), measuring approximately 0.25 inches in depth (along a line between the edge and the base 36), and protruding inwardly 0.13 inches (width). The width of the indentation (0.13 inches) measures the maximum amount of the indentation available to over-lap and engage the lip of the first member to maintain the closure. In other words, once the container is in the closed position, the lip of the first member need only be displaced inwardly a maximum of 0.13 inches before the container will open. Unfortunately, foamed plastic containers cannot always be formed with enough precision to take advantage of the entire 0.13 inches of overlap. In practice, the lip may only be engaged by one-half this amount due to distortion. This deficiency results in a closure which is unstable and prone to failure. Furthermore, the amount of overlap cannot be increased by increasing the width of the indentation without also making an unnecessarily large rim 37 on the second member, which would be wasteful of material and more costly. The reason for this is that the indentation 31 cannot be inwardly extended beyond the edge 38 of the slot 33. Any indentation beyond the slot would prevent the container from being released from the mold due to the creation of an undercut. (See FIG. 13) To avoid this mold release problem, the prior art containers created a "step" configuration in the rim 37 of the second member to allow the indentation to extend inwardly as far as the "step" extends. (See FIGS. 10 and 13). This is not a particularly satisfactory solution.

A further disadvantage of this type of closure is that the generally rectangular indentation creates mechanical stresses where the indentation merges with the sidewall. The rather well-defined edges and corners are structurally weakened and create the possibility of failure when the container is repeatedly opened and closed.

SUMMARY OF THE INVENTION

The object of this invention is to provide a new and useful stackable container having a sturdy, secure, quick, and simple snap closure means.

Broadly, the invention resides in a deformable container comprising first and second members; wherein said first member has a protruding edge or lip; wherein said second member has a generally flat base and a sidewall which is outwardly inclined; and wherein said second member has at least one inwardly protruding surface, located on the outwardly inclined sidewall, having a void space within which is adapted to receive the protruding edge of the first member to effect a snap closure. The inwardly protruding surface may extend from the base of the second member to a point beyond the void space, which may be a slot, but it is preferred that the inwardly protruding surface be extended all the way to the upper edge of the sidewall. In this preferred embodiment the inwardly protruding surface merges with the upper edge of the sidewall via a generally flat surface which is generally parallel to the base of the second member. This flat slops gently toward the slot or void space, and provides the closure with structural stability as well as a means to guide the lip of the first member into the slot or void space.

More specifically, the inwardly protruding surface may be defined as a longitudinal segment of a parabolic cylinder, such that the intersection of the inwardly protruding surface with an imaginary plane parallel to the base results in a concave line. Similarly, the inwardly protruding surface may be defined as a longitudinal segment of a circular cylinder, such that the intersection of the inwardly protruding surface with an imaginary plane parallel to the base results in a concave line. The radius of curvature of the circularly cylindrical surface may range from 0.25 inches to 12 inches, depending upon the size of the container and the number of inwardly protruding surfaces.

Most specifically, the container may be produced from a continuous sheet of foamed polystyrene.

In a further aspect the invention resides in a deformable container comprising first and second members; wherein said first member has a protruding edge or lip; wherein said second member has a generally flat base and a sidewall which is outwardly inclined; and wherein said second member has at least one inwardly protruding surface, located in the outwardly inclined sidewall, having a non-rectangular slot within, said slot being able to accept the protruding edge of the first member to effect a snap closure.

More specifically, the slot may be generally concave in shape, such that the lip of the first member has initial frictional contact with the apex of the slot only, thus allowing the slot to engage the lip more easily and quickly.

More specifically, the inwardly protruding surface may extend from the edge of the sidewall of the second member to a point between the slot and the base, and gradually merge with the sidewall in such a manner that no undercut is present. This is accomplished when the surface of the inward protrusion is outwardly inclined at an angle less than that of the sidewall (said angle measured from the base of the second member).

Alternatively, the slot may be generally V-shaped with the point of the V (apex) pointing inward. This also will accomplish a quick and easy snap closure.

The advantages of this container over others in the prior art are several.

First, because the inwardly protruding surface does not create an undercut in the sidewall of the second member, the container is easily removed from the mold.

Second, because there are no reverse-tapered sections in the sidewall, the container stacks very well.

Third, because there is no limitation on the extent or width of the inward protrusion, the extent to which the slot overlaps the lip of the first member can be as great as is necessary to assure that the closure will not fail.

Fourth, because of the concave shape of the inward protrusion and the gently curving surfaces where the protrusion merges with the sidewall, there are no well-defined corners or edges which may be weakened by mechanical stresses. Coupled with the flat surface which merges the inwardly protruding surface with the upper edge of the sidewall, this design provides a sturdy and durable snap closure.

Fifth, because of the concave design, the lip of the first member is more easily engaged by the slot, resulting in a quicker and more reliable closure. As the container is being closed, the lip of the first member only makes contact with the apex of the curvature of the inwardly protruding surface. This reduces the likelihood of the container not closing quickly and easily since there are fewer friction points to prevent a proper closure. Once the lip has entered the apex of the slot, it simply slides in the rest of the way. This is to be contrasted with the rectangular protrusion and the Z-cross section closure means of the prior art, which require that the lip be properly aligned along the entire length of the slot before the lip will enter the slot.

BRIEF DESCRIPTION OF THE DRAWINGS

FIG. 1 shows a perspective view from the bottom of one form of container in the locked position.

FIG. 2 shows a fragmentary bottom view of the container of

FIG. 3 shows a fragmentary sectional view of the first and second members just before the first member "snaps" into the second member.

FIG. 4 shows the same fragmentary sectional view of FIG. 3, but with the first and second members locked in the closed position.

FIG. 5 shows a fragmentary top view of the container in FIG. 1.

FIGS. 10–13 show views of a prior art container. (See Description of the Prior Art on page 2).

DESCRIPTION OF THE PREFERRED EMBODIMENTS

Figure 8:
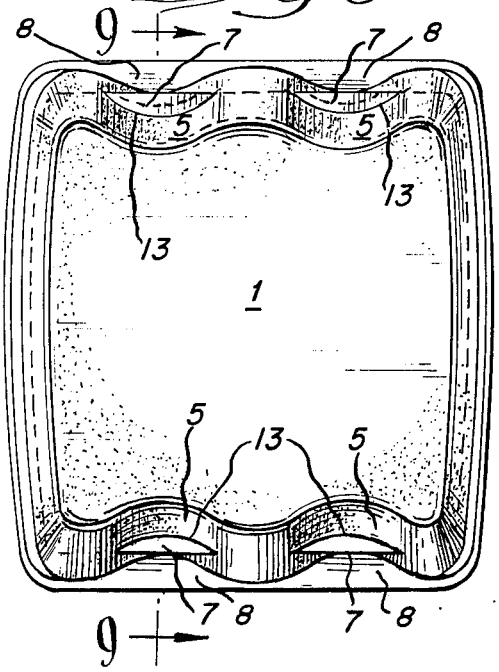
FIG. 8 shows a bottom view of a two-piece container having two locking means at opposite sides.

Directing attention to the drawings, our invention will be described in more detail. It is emphasized that since the essence of this invention lies in the snap closure device, the description has been generally limited to that portion of the containers illustrated. However, several different containers embodying this invention are shown to illustrate some of the more preferable possibilities.

FIG. 1 shows a perspective view of one preferred embodiment of a hinged container in the closed position. The hinge (not visible in this view) is molded into the container so that the first and second members actually leave the mold connected to each other by an integral hinge. Such a container is ideal for carrying a variety of foods simultaneously because of the compartmentalized second member. Specifically shown are an outwardly inclined sidewall 19 of the first (top) member and a protruding edge or lip 7 at the extremity of said sidewall. Also shown is the second (bottom) member having a generally flat base 1, four outwardly inclined sidewalls 2 (two not visible in this view), two inwardly protruding surfaces 5 located in an outwardly inclined sidewall, a void space or slot 13 which engages the lip 7 of the first member to effect a snap closure, and a generally flat surface 21, which is generally parallel to base 1, which merges the inwardly protruding surface 5 with the upper edge 11 of the sidewall. A third inwardly protruding surface 9 provides a thumb grip which aides in opening the container, but this surface does not affect the functioning of the snap considerably and still be within the scope of this invention. It is preferable, however, that the surfaces have gently curving lines to prevent stresses from weakening the closure. Specifically, the inwardly protruding surface may be defined as a longitudinal segment of a parabolic cylinder where the cylinder has been segmented by a plane more or less parallel to the cylinder's axis, such that the intersection of the inwardly protruding surface with an imaginary plane parallel to the base 1 results in a concave line.

More specifically, the inwardly protruding surface may be defined as a longitudinal segment of a circular cylinder, such that the intersection of the inwardly protruding surface with an imaginary plane parallel to the base results in a concave line. In the preferred embodiments, the radius of curvature of the circular cylinder is approximately 1.5 inches. The surface protrudes inwardly 0.30 inches at its apex and measures 1.5 inches across at the slot (measured parallel to the edge of the sidewall). The length of the protrusion depends upon the depth of the container, but typically is 1.5 inches.

FIG. 2 is a fragmentary bottom view of the container in FIG. 1, showing the generally flat base 1 of the second member, three outwardly inclined sidewalls 2, two inwardly protruding surfaces 5 extending from the base 1 to the upper edge 11 of the sidewall, the protruding lip 7 of the first member engaged by slots 13 in the inwardly protruding surfaces 5, the generally flat surfaces 21 which merge the inwardly protruding surfaces 5 with the upper edge 11 of the sidewall.

FIG. 4 is a fragmentary section taken along line 4—4 of FIG. 2, which with FIG. 3 illustrates the operation of the snap closure. In FIG. 3, the lip of the first member is being pressed downward against the generally flat surface 21. As further pressure is applied, the lip 7 will force the inwardly protruding surface 5 in sidewall 2 outward until the lip reaches the slot 13. At this point, the sidewall snaps back to its normal position as the lip is thrust into the slot, effecting a snap closure. This closed position is illustrated in FIG. 4.

FIG. 5 is a fragmentary top view of the container of FIG. 1, showing a generally flat top surface 18 of the first member, outwardly inclined sidewalls 19, a protruding edge or lip 7, two inwardly protruding surfaces 5, and the upper edge 11 of the sidewalls of the second member (bottom).

Figure 6:
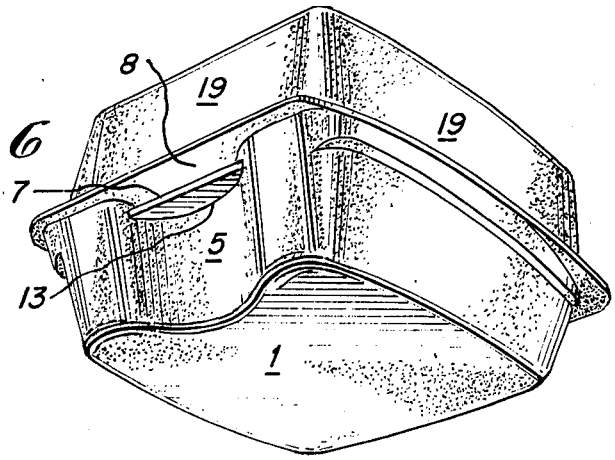
FIG. 6 shows a perspective view of a hinged container using a single locking means on the sidewall opposite the hinge.

FIG. 6 shows a perspective view of a preferred embodiment having all the elements numbered in the previous figures, except only one inwardly protruding surface 5 is used as the closure means. This container also has an integral hinge along the edge opposite the sidewall having the snap closure. This container is ideal for food items such as hamburgers, and because of its small size, only one snap closure device is necessary. For some containers such as shown in FIG. 1, two or more snap closures are preferred. Although not shown, it is within the scope of this invention to place the inwardly protruding surfaces in the corners of the container. This would be ideal for generally square containers which contain a round item such as a hamburger. Such placement would provide maximum use of available space and result in a savings in materials.

Figure 7:
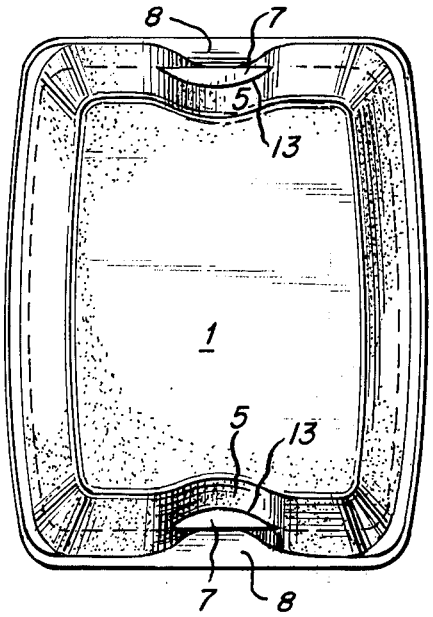
FIG. 7 shows a bottom view of the container in FIG. 6.

FIG. 7 shows a bottom view of a container without a hinge having one snap closure on each of two opposite sidewalls of the container.

FIG. 8 shows a bottom view of a container similar to the container in FIG. 7, except two snap closure means used on each of two opposite sidewalls. These would be necessary for larger containers having heavier loads.

Figure 9:
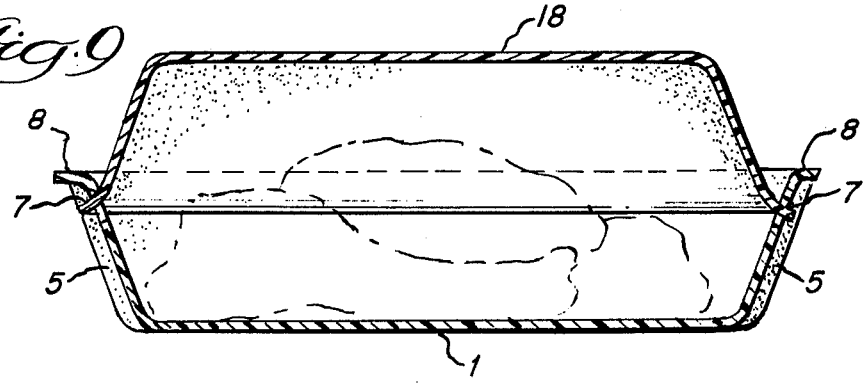
FIG. 9 shows a longitudinal cross-section of the container in FIG. 8.

FIG. 9 is a cross-sectional view along line 9—9 in FIG. 8, illustrating the snap closure as detailed in FIGS. 3 and 4. Even though this embodiment does not have a hinge, the snap closure operates in an identical manner.

It will be obvious to those skilled in the art that many variations may be made in the embodiments chosen for the purpose of illustrating the present invention without departing from the scope thereof.

We claim:

1. A deformable container comprising first and second members; wherein said first member has a protruding edge or lip; wherein said second member has a generally flat base and a sidewall which is outwardly inclined; and wherein said second member has at least one inwardly protuding surface, located on the outwardly inclined sidewall, having a void space within which passes therethrough and is adapted to receive the protruding edge of the first member to effect a snap closure.

2. The container in claim 1 wherein each inwardly protruding surface extends from the base of the second member to a point beyond the void space.

3. The container in claim 1 where each inwardly protruding surface extends from the base of the second member to the upper edge of the sidewall.

4. The container in claim 3 where the inwardly protruding surface merges with the upper edge of the sidewall via a generally flat surface which is generally parallel to the base of the second member.

5. The container in claim 4 wherein the inwardly protruding surface may be defined as a longitudinal segment of a parabolic cylinder, such that the intersection of the inwardly protruding surface with an imaginary plane parallel to the base results in a concave line.

6. The container in claim 4 wherein the inwardly protruding surface may be defined as a longitudinal segment of a circular cylinder, such that the intersection of the inwardly protruding surface with an imaginary plane parallel to the base results in a concave line.

7. The container in claim 6 wherein the radius of curvature of the inwardly protruding surface is at least 0.25 inches and not more than 12 inches.

8. The container in claim 7 wherein the container is produced from a continuous sheet of foamed polystyrene.

9. The container in claim 8 wherein there is one inwardly protruding surface located on a sidewall opposite an integral hinge joining the first and second members.

10. The container in claim 8 wherein there is at least one inwardly protruding surface on opposite sides of the container.

11. The container in claim 8 wherein there is one inwardly protruding surface located in each corner of the container.

12. A deformable container comprising first and second members; wherein said first member has a protruding edge or lip; wherein said second member has a generally flat base and a sidewall which is outwardly inclined; and wherein said second member has at least one inwardly protruding surface, located on the outwardly inclined sidewall, having a non-rectangular slot within, said slot adapted to accept the protruding edge of the first member to effect a snap closure.

13. The container in claim 12 wherein the non-rectangular slot has a V-shape, where the apex of the V points generally toward the inside of the container.

14. The container in claim 12 wherein the non-rectangular slot is a concave slot.

15. The container in claim 14 wherein the inwardly protruding surface extends from the edge of the sidewall of the second member to a point between the slot and the base; and wherein the inwardly protruding surface gradually merges with the sidewall in such a manner that no undercut is present.

* * * * *